US005934555A

United States Patent [19]

Döbbeling et al.

[11] Patent Number: 5,934,555

[45] Date of Patent: Aug. 10, 1999

[54] PRESSURE ATOMIZER NOZZLE

[75] Inventors: Klaus Döbbeling, Windisch, Switzerland; Peter Jansohn, Kadelburg, Germany; Hans Peter Knöpfel, Besenbüren; Christian Steinbach, Neuenhof, both of Switzerland

[73] Assignee: ABB Research Ltd., Zurich, Switzerland

[21] Appl. No.: 08/811,006

[22] Filed: Mar. 4, 1997

[30] Foreign Application Priority Data

Mar. 5, 1996 [DE] Germany ..... 196 08 349

[51] Int. Cl.[6] ..... B05B 17/04

[52] U.S. Cl. ..... 239/11; 239/404; 239/405; 239/600

[58] Field of Search ..... 239/590, 590.3, 239/399, 403, 404, 405, 406, 461, 463, 466, 8, 423, 424, 11, 426, 491, 1, 493, 600

[56] References Cited

U.S. PATENT DOCUMENTS

| | | | |
|---|---|---|---|
| 2,539,778 | 1/1951 | Grimmeisen | 239/403 |
| 2,612,405 | 9/1952 | Kirschbaum | 239/404 |
| 3,512,719 | 5/1970 | Phelps et al. | 239/405 |
| 3,638,865 | 2/1972 | McEneny et al. | 239/404 X |
| 3,717,306 | 2/1973 | Hushon et al. | 239/404 |
| 3,804,333 | 4/1974 | Kramer et al. | 239/406 X |
| 4,094,469 | 6/1978 | Woringer | 239/405 |

FOREIGN PATENT DOCUMENTS

| | | |
|---|---|---|
| 0321809B1 | 6/1989 | European Pat. Off. . |
| 0496016B1 | 7/1992 | European Pat. Off. . |

OTHER PUBLICATIONS

"Lexikon der Energietechnik und Kraftmaschinen", von Miller, 1965.

*Primary Examiner*—Andres Kashnikow
*Assistant Examiner*—Steven J. Ganey
*Attorney, Agent, or Firm*—Burns, Doane, Swecker & Mathis, L.L.P.

[57] ABSTRACT

A pressure atomizer nozzle comprises a nozzle body (30) in which is formed a turbulence and/or swirl chamber (39) and having a nozzle bore (33). At least one first feed channel (41, 41*a*) for the liquid (37) to be atomized connects to the chamber as a first feed stage for feeding said liquid (37) under pressure. At least one second feed channel (38) connects to the chamber as a second feed stage for feeding part of the liquid (37) to be atomized or for feeding a second liquid (37') to be atomized. The second feed channel feeds liquid into the chamber under pressure and with a swirl. The two stage pressure atomizer nozzle allows, for example, simple adaptation of the fuel spray cone angle to the respective operating conditions of a gas turbine burner.

16 Claims, 10 Drawing Sheets

$\dot{m}_{BS}$
ITEM 34
R
SWIRL NOZZLE WITH NARROW SPRAY CONE ANGLE
SWIRL NOZZLE WITH WIDE SPRAY CONE ANGLE $\dot{m}_{BS}$
ITEM 34
R
TURBULENCE-ASSISTED NOZZLE
SWIRL NOZZLE

PRESSURE ATOMIZER NOZZLE

BACKGROUND OF THE INVENTION

1. Field of the Invention

The invention relates to the area of combustion technology. It relates to a pressure atomizer nozzle comprising a nozzle body in which there is formed a turbulence and/or swirl chamber which is connected via a nozzle bore to an outer space and has at least one feed channel for the liquid to be atomized, through which said liquid can be fed in under pressure, and to a method for operating this pressure atomizer nozzle.

2. Discussion of Background

Atomizer burners in which the oil which is burnt is finely divided by mechanical means are known. The oil is broken up into fine droplets of about 10 to 400 $\mu$m diameter (oil mist) which vaporize and burn when mixed with the combustion air in the flame. In pressure atomizers (see Lueger—Lexikon der Technik, [Encyclopedia of Technology], Deutsche Verlags-Anstalt Stuttgart, 1965, Volume 7, p 600), the oil is fed to an atomizer nozzle under high pressure by an oil pump. Through essentially tangentially extending slots, the oil passes into a swirl chamber and leaves the nozzle via a nozzle bore. This ensures that two components of motion, an axial component and a radial component, are imparted to the oil droplets. The oil film emerges from the nozzle bore as a rotating hollow cylinder and expands due to the centrifugal force to form a hollow cone whose edges enter into unstable vibration and break up into small oil droplets. The atomized oil forms a cone with an aperture angle of greater or lesser size.

However, in the case of combustion of mineral fuels with low pollutant emissions in modern burners, for example in premix burners of the double-cone type, the basic structure of which is described in EP 0 321 809 B1, special requirements are made of the atomization of the liquid fuel. These are, in particular, the following:

1. The droplet size must be small to ensure that the oil droplets can vaporize completely before combustion.
2. The opening angle (angle of spread) of the oil mist should be small, especially in the case of combustion at elevated pressure.
3. The droplets must have a high speed and a high momentum in order to be able to penetrate sufficiently far into the compressed mass flow of combustion air and thereby ensure that the fuel vapor can premix completely with the combustion air before it reaches the flame front.

Swirl nozzles (pressure atomizers) and air-assisted atomizers of the known types with a pressure of up to about 100 bar are hardly suitable for this purpose because they do not permit a small angle of spread, the quality of atomization is limited and the momentum of the droplet sprays is low.

As a result of this inadequate vaporization and premixing of the fuel, addition of water is therefore necessary for local reduction of the flame temperature and hence of $NO_x$ formation. Since the water fed in often also disturbs flame zones, which, although producing little $NO_x$ themselves, are very important for flame stability, instabilities, such as flame pulsation and/or poor burn-up, often occur, leading to an increase in CO emissions.

An improvement can be achieved with the high-pressure atomizer nozzle disclosed in EP 0 496 016 B1. This comprises a nozzle body in which there is formed a turbulence chamber which is connected via at least one nozzle bore to an outer space and has at least one feed channel for the liquid to be atomized, which can be fed in under pressure. It is distinguished by the fact that the cross sectional area of the feed channel opening into the turbulence chamber is greater by a factor of 2 to 10 than the cross sectional area of the nozzle bore. This arrangement makes it possible to produce a high level of turbulence in the turbulence chamber and this does not die away on the way to the outlet from the nozzle. The jet of liquid is induced to break up rapidly by the turbulence produced in the outer space in front of the nozzle bore, i.e. after it leaves the nozzle bore, small angles of spread of 20° and less being obtained. The droplet size is likewise very small.

When operating gas turbine burners with liquid fuel, the aim is to produce, as far as possible over the entire load range of the gas turbine (about 10% to 120% of fuel mass flow in relation to rated load conditions), a droplet spray which allows stable combustion with low pollutant emissions in a predetermined airflow field in the entire range.

It is true that, as desired, the use of a high-pressure atomizer nozzle as described above for atomizing liquid fuel in gas turbine burners leads to a not excessively high pressure (100 bar) and a small droplet size at full load and overload (100–120%), unwanted wall wetting and carbonization being avoided by virtue of the narrow spray angle.

At partial load, however, the fuel feed pressure falls due to the falling total fuel mass flow. The energy required for atomization for pressure atomizers is, however, determined by the fuel feed pressure, with the result that there is a deterioration in the quality of atomization in this load range and the depth of penetration of the fuel spray into the airstream is decreased due to the low fuel feed pressure.

SUMMARY OF THE INVENTION

Accordingly, one object of the invention is to develop a pressure atomizer nozzle which is of simple construction, requires only a small amount of installation space and permits a spray angle of the liquid to be atomized matched to the respective operating conditions. When using this pressure atomizer nozzle in a gas turbine burner, a sufficiently high nozzle feed pressure should be produced even at low fuel mass flows (about 25% in relation to rated load conditions), while the nozzle should not require an excessively high nozzle feed pressure at high fuel mass flows (about 100–120% in relation to rated load conditions). With the droplet spray produced in this way, stable combustion with low pollutant emissions should be made possible over the entire load range of the gas turbine.

According to the invention, this is achieved, in a pressure atomizer nozzle comprising a nozzle body in which there is formed a turbulence and/or swirl chamber which is connected via a nozzle bore to an outer space. The nozzle has at least one first feed channel for the liquid to be atomized, through which said liquid can be fed in under pressure. At least one further feed channel for part of the liquid to be atomized or for a second liquid to be atomized opens into the chamber and through this feed channel the part of the liquid or the second liquid can be fed in under pressure and with a swirl.

The advantages of the invention consist, inter alia, in that adaptation of the droplet spray (quality of atomization, droplet size, spray angle) to the respective load conditions is made possible by this two-stage pressure atomizer nozzle. The nozzle is furthermore distinguished by its simple construction, which requires only a small amount of space.

It is particularly expedient if the pressure atomizer nozzle is designed in such a way that the liquid to be atomized can be fed into the chamber without swirl via the first feed channel/feed channels. The main atomizer stage thus comprises a swirl-free turbulence-assisted pressure atomizer nozzle which, at high nozzle feed pressures, e.g. 100 bar, provides very fine atomization with extremely small spray angles. By virtue of the combination of this turbulence atomizer stage with the swirl stage described above, in which small droplets are produced at low throughput rates, good adaptation of the atomization to the respective operating conditions can be accomplished. That part of the liquid to be atomized which is introduced into the chamber through the swirl channels rotates in the chamber. The rotary motion produces a hollow conical flow at the nozzle orifice, with the result that, from a certain proportion by mass onwards fed in through the swirl stage, the liquid emerges from the nozzle only as a film. If the proportion by mass of the swirl stage is increased as the total mass flow of liquid falls, the liquid feed pressure can be held at a higher level, allowing fine atomization to be maintained even in the case of a low mass flow. The liquid spray cone angle is greater at low load and this compensates for the lesser depth of penetration of the liquid spray into the airflow. Since a very small spray cone angle is desired at full load and overload, the liquid mass flow to be atomized flowing in through the swirl channels is reduced or completely shut off in these cases.

It is furthermore advantageous if, in the case of the pressure atomizer nozzle according to the invention, the liquid to be atomized can be fed into the chamber with swirl via the first feed channel/feed channels. A two-stage pressure swirl atomizer nozzle is thereby formed in which both stages are combined in a common chamber, which is here a swirl chamber. If the liquid to be atomized is now passed into the main swirl stage with little swirl, a narrow spray angle of a liquid to be atomized is achieved.

In full-load and overload operation, the pressure atomizer nozzle is operated with little swirl by way of a main pressure swirl stage by feeding all the liquid to be atomized to the swirl chamber with a swirl via at least one first feed channel. A swirling flow is produced there which then passes into the outer space through the nozzle bore. In part-load and low-load operation, the pressure atomizer nozzle is additionally operated by way of a further pressure swirl stage with a greater swirl by feeding part of the liquid to be atomized or a second liquid to be atomized to the chamber with a greater swirl via the further feed channel or channels. A flow is produced there with a high degree of swirl which then passes into the outer space through the nozzle bore, the proportion of the liquid with a greater swirl fed in by the further swirl stage being increased as the total mass flow of liquid falls. Using this operation method, excellent adaptation of the atomization to the respective load range can be accomplished.

A smooth switch over between the two stages is advantageous, as is operation of the nozzle with just one of the two stages, depending on load conditions.

Advantageous developments of the pressure atomizer nozzle according to the invention are described below.

Finally, it is advantageous if the nozzle according to the invention is installed in a premix burner of the double-cone type or a four-slot burner, part of the combustion air (about 3 to 7%) being guided around the nozzle as an enveloping stream close to the nozzle. Local separation and recirculation zones are thereby avoided. The recirculation zone is prevented from being displaced into the interior of the burner.

BRIEF DESCRIPTION OF THE DRAWING

A more complete appreciation of the invention and many of the attendant advantages thereof will be readily obtained as the same becomes better understood by reference to the following description when considered in connection with the accompanying drawings, wherein.

DESCRIPTION OF THE PREFERRED EMBODIMENTS

Figure 2:
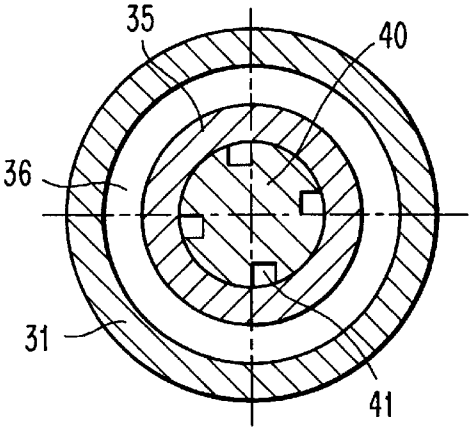
FIG. 2 shows a cross section of the pressure atomizer nozzle shown in FIG. 1 in the region of the turbulence stage, along the line II—II.
Figure 3:
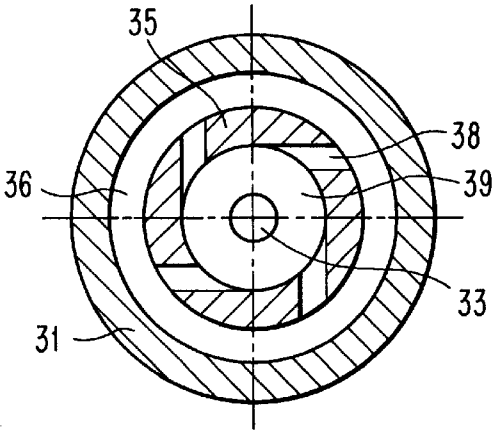
FIG. 3 shows a cross section of the pressure atomizer nozzle shown in FIG. 1 in the region of the swirl stage, along the line III—III.
Figure 1:
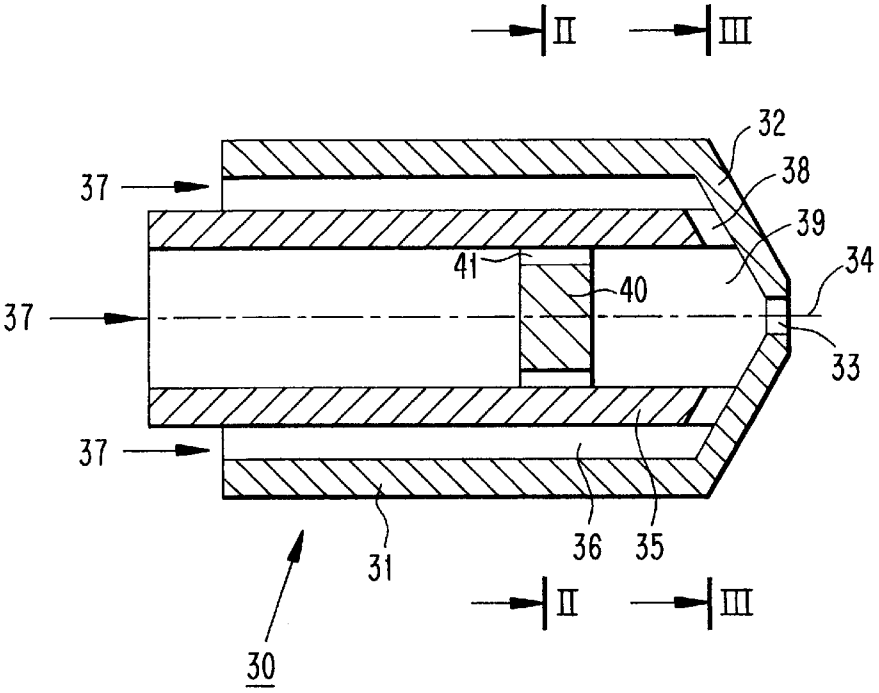
FIG. 1 shows a partial longitudinal section through a pressure atomizer nozzle with a turbulence stage and a swirl stage.

Referring now to the drawings, wherein like reference numerals designate identical or corresponding parts throughout the several views, in which only those elements essential to an understanding of the invention are shown and in which the direction of flow of the media is indicated by arrows, in FIGS. 1 to 3 a first exemplary embodiment of the invention is shown. FIG. 1 shows the pressure atomizer nozzle in a partial longitudinal section and FIG. 2 and 3 show two cross sections in different planes.

The pressure atomizer nozzle comprises a nozzle body 30 consisting of a first tube 31, which is closed at its end as seen in the direction of flow by a conical cap 32. Arranged in the middle of the cap 32 is a nozzle bore 33, the longitudinal axis of which is denoted by 34. Inserted into the tube 31 is a second tube 35, which has a smaller outside diameter than the inside diameter of the first tube 31, reaches as far as the cap 32 and rests on the latter. The annular space 36 between the two tubes 31 and 35 serves for feeding in the liquid 37 to be atomized or some of this liquid. That end of the tube 35 which rests on the cap 32 is provided with four tangentially arranged slots 38 which establish a connection between the annular space 36 and a chamber 39 which serves as a swirl chamber for the liquid 37 to be atomized flowing in through the slots 38. The chamber 39 is bounded by the inner walls of the cap 32 and of the second tube 35, and by a filler piece 40 which is pushed into the interior of the second tube 35 and secured therein. This filler piece 40 is spaced from the upper edge of the slots 38 but, in another embodiment variant, can also be at the same level. Arranged in the filler piece 40 are four feed channels 41 for the liquid 37 to be atomized, these channels permitting swirl-free inflow of the liquid 37 into the chamber 39, the chamber 39 thus serving in this case as a turbulence chamber. The pressure atomizer nozzle according to the invention thus has two stages—a turbulence production stage (see FIG. 2) and a pressure swirl stage (see FIG. 3).

As a departure from the exemplary embodiment illustrated, the pressure atomizer nozzle can also be provided with more or fewer slots 38 or feed channels 41. The feed channel 41, can for example, extend over the entire circumference of the filler piece 40, giving rise to an annular gap as a feed channel into the turbulence chamber 39. Some other distribution of the channels over the circumference is also likewise possible.

Figure 5:
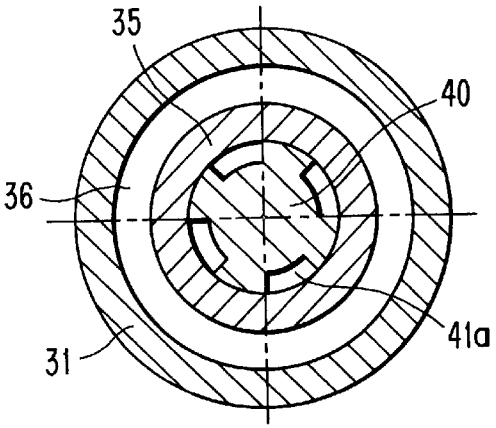
FIG. 5 shows a cross section of the pressure atomizer nozzle shown in FIG. 4 in the region of the main swirl stage, along the line V—V.
Figure 6:
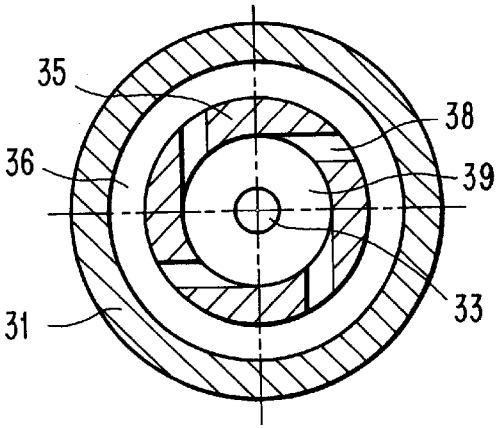
FIG. 6 shows a cross section of the pressure atomizer nozzle shown in FIG. 4 in the region of the further swirl stage, along the line VI—VI.
Figure 4:
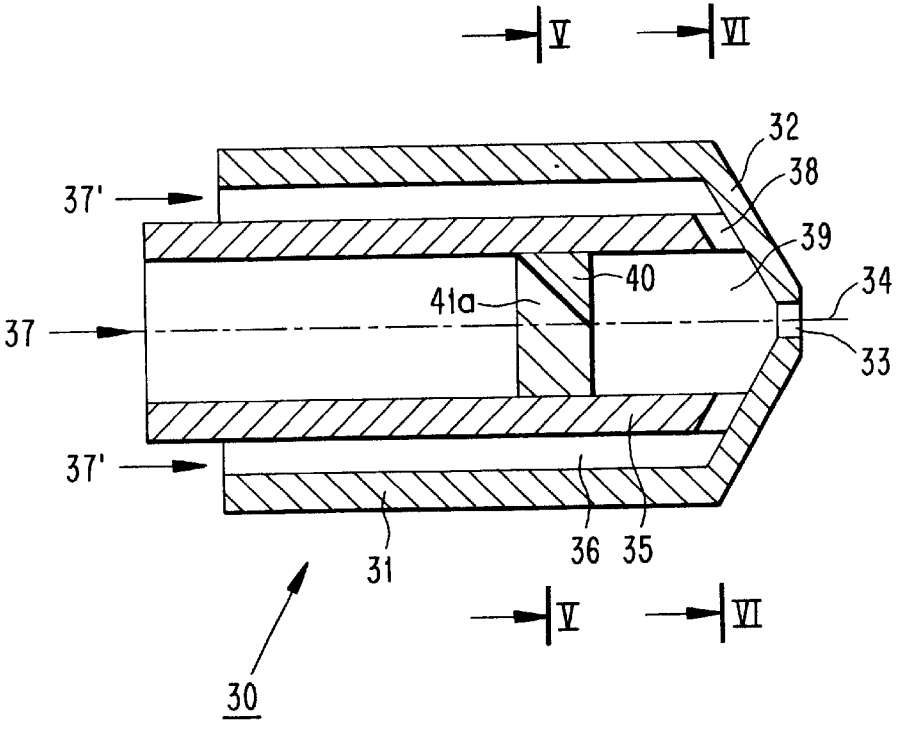
FIG. 4 shows a partial longitudinal section through a pressure atomizer nozzle with two swirl stages.

FIGS. 4 to 6 show another exemplary embodiment of the invention, FIG. 4 illustrating the pressure atomizer nozzle according to the invention in a partial longitudinal section and FIGS. 5 and 6 showing two cross sections in different planes.

The construction of the nozzle differs from the exemplary embodiment described above only in that, instead of the turbulence production stage, there is a main swirl stage in the nozzle. For this purpose, the feed channels 41*a*, in contrast to the feed channels 41 in FIG. 1, are not arranged in axial alignment in the filler piece 40 but arranged tangentially, so that the liquid 37 to be atomized passes with a swirl into the chamber 39 both via the channels 38 and via the channels 41*a*. It is important here that the liquid 37 to be atomized has only a slight swirl leading to a narrow spray cone angle $\phi$ once it has flowed through the channels 41*a*, while the swirl of the liquid 37 after flowing through the channels 38 is greater, thus allowing a larger spray cone angle to be achieved. The exemplary embodiment shown in FIG. 4 illustrates that the nozzle is supplied with two liquids 37 and 37' to be atomized. Both liquids 37, 37' are fed to the chamber 39, which in this case is a pure swirl chamber, with a swirl, the liquid 37 having a lesser swirl than the liquid 37'. By means of the difference in the degree of swirl, the spray cone angle $\phi$ and hence the distribution of the liquid mass flow following the nozzle can be influenced.

Figure 7:
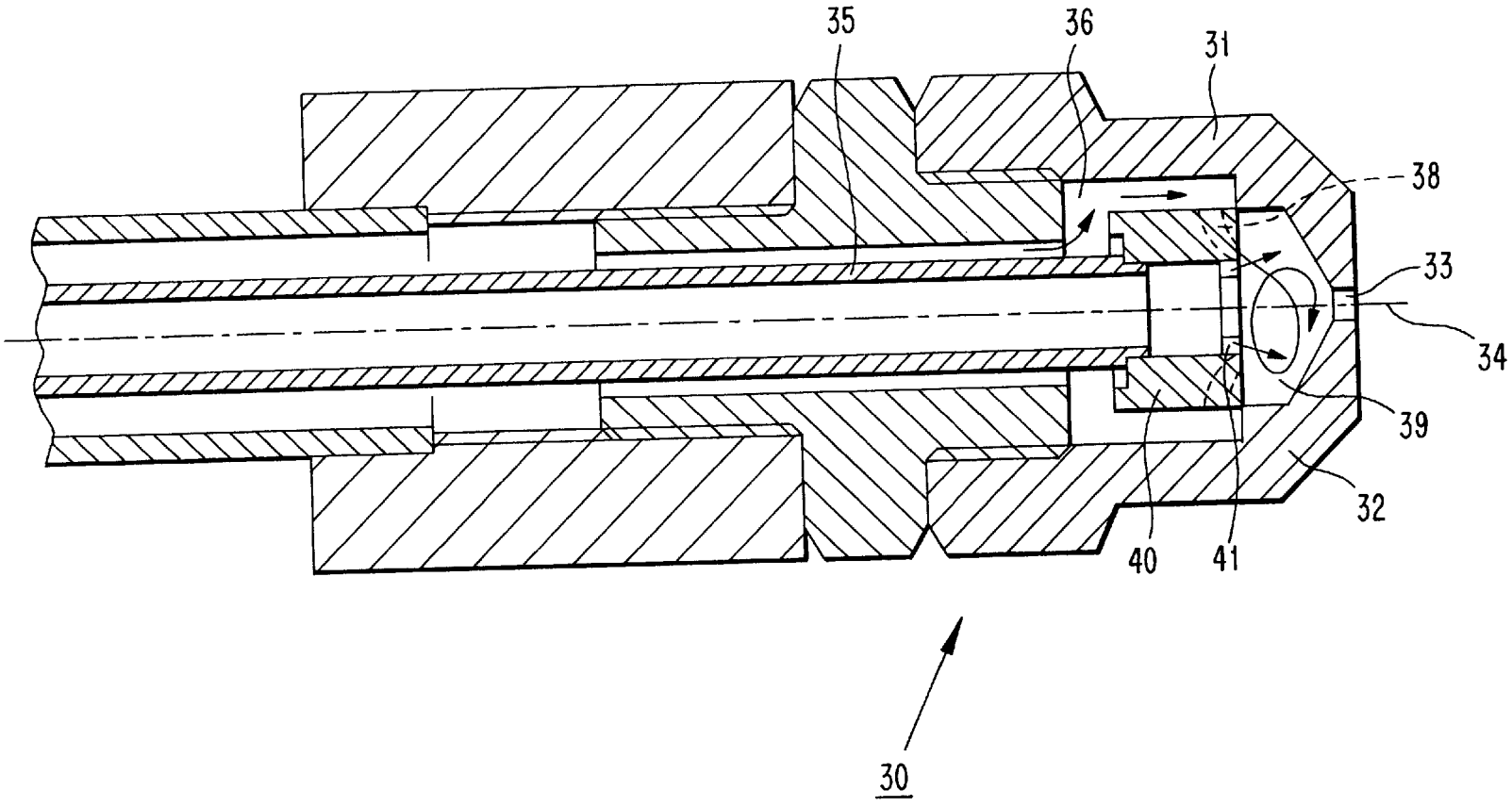
FIG. 7 shows a partial longitudinal section through a pressure atomizer nozzle as in FIG. 1 in another embodiment variant.

FIG. 7 shows another embodiment variant of a two-stage pressure atomizer nozzle according to the invention with a turbulence production stage and a swirl stage. The pressure atomizer nozzle comprises a nozzle body 30 comprising a first tube 31, which is closed at its end as seen in the direction of flow by a conical cap 32. The nozzle bore 33 is again arranged in the cap 32. Inserted into the first tube 31 is a second tube 35, which has a smaller outside diameter than the inside diameter of the first tube 31, with the result that an annular channel 36 is formed between the tubes 31 and 35. It is possible, in accordance with FIG. 7, this channel 36 has different heights due to different inserts. This annular channel 36 serves as a feed line for a swirl stage. The second tube 35 is bounded by a filler piece 40 of relatively large diameter which surrounds the chamber 39 with the cap 32 of the first tube 31. Arranged in the filler piece 40 there is at least one tangentially arranged swirl channel 38 for the purpose of connecting the annular channel 36 to the chamber 39. 6 channels 38, for example, are advantageous. Arranged parallel to the axis in the second tube 35 and in the filler piece 40 there is furthermore at least one feed channel 41 as a turbulence channel for the liquid to be atomized, the feed channel/feed channels 41 opening into the swirl channel/swirl channels 38.

It is, of course, also possible to arrange the channels 38 and 41 in such a way that, for example, the swirl channels 38 open into the channels 41, so that the liquid to be atomized passes into the chamber 39 only via the channels 41.

Figure 8:
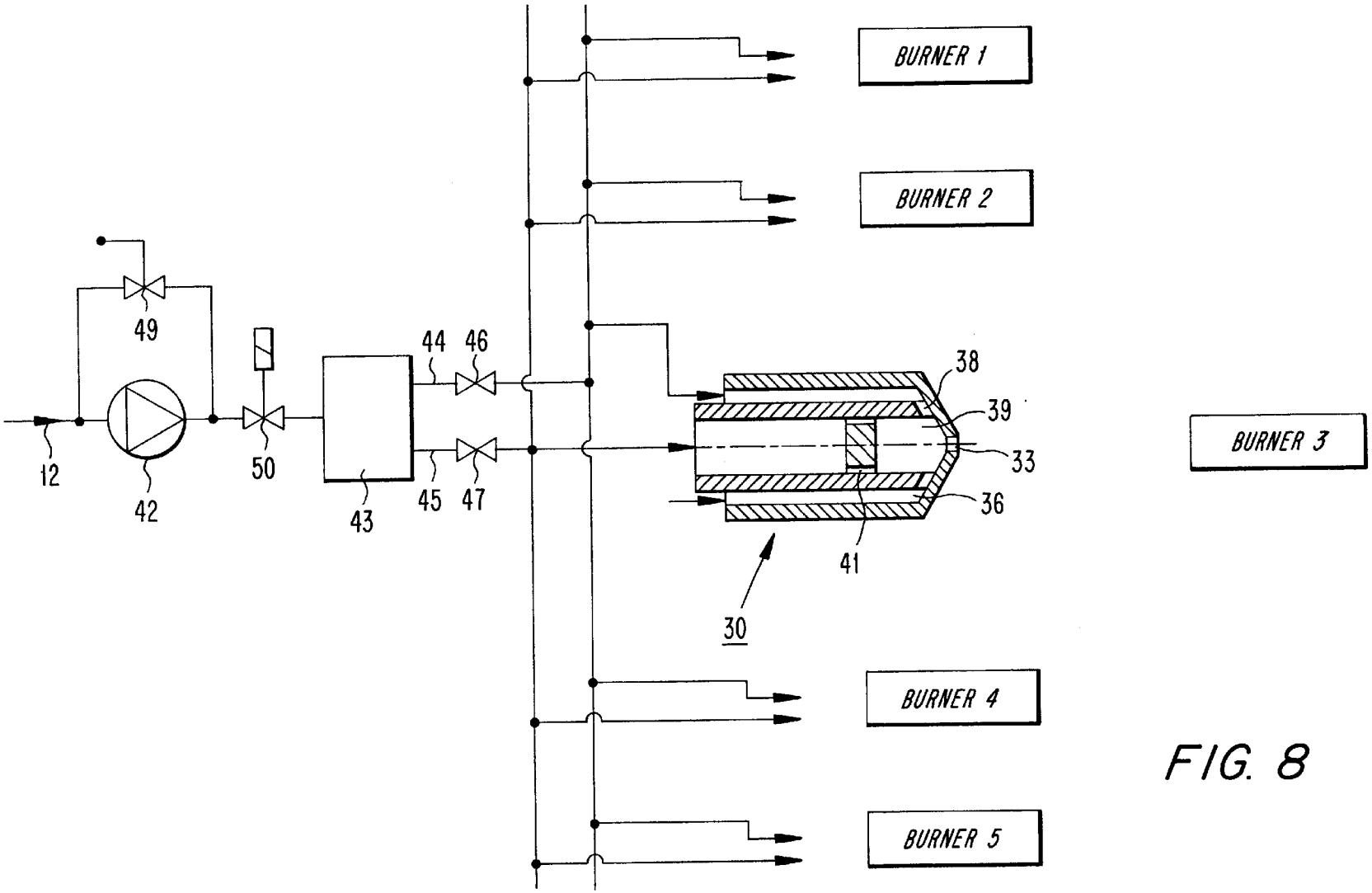
FIG. 8 shows a schematic representation of the liquid feed system for the two-stage pressure atomizer nozzle, oil being atomized in both stages.

FIG. 8 shows, in a schematic representation, one possible liquid feed system to the pressure atomizer nozzle. By means of a pump 42, the liquid to be atomized, in this case liquid fuel (oil) 12, is pumped into a pressure vessel 43. A return valve 49 serves for the setting of the pump feed pressure. Arranged in the fuel line between the pump 42 and the pressure vessel 43 is a shut-off valve 50. Two lines 44, 45 leave the pressure vessel 43, line 44 feeding the annular space 36 (and hence the swirl atomizer stage) and line 45 being connected to the feed channels 41 (turbulence production stage) and 41*a* (swirl atomizer stage). Arranged in each of the lines 44 and 45 is a control valve 46 and 47, respectively, which allow regulation of the respective quantity of liquid fed in. Depending on requirements, it is also possible for one of the two valves 46, 47 to be completely closed, so that in this case only one of the two atomizer stages of the nozzle is in operation. A smooth switch over between the two stages is possible. As indicated in FIG. 8, a plurality of burners, belonging for example to a gas turbine combustion chamber, is to be supplied with fuel by way of this fuel feed system. The circuit arrangement shown has the advantage that only the two valves 46, 47, i.e. just one control valve per stage, are necessary for controlling the two atomizer stages.

Figure 9:
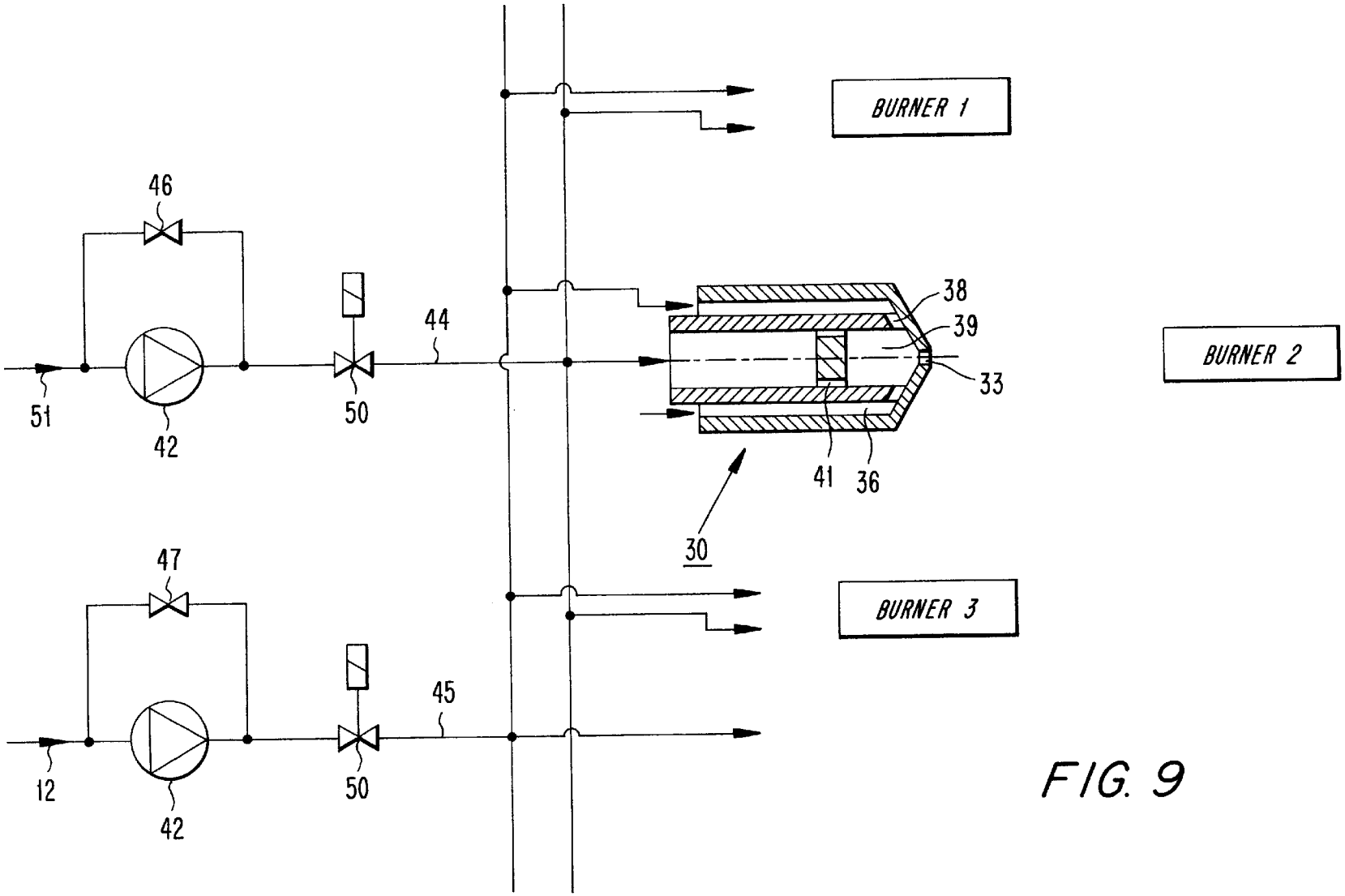
FIG. 9 shows a schematic representation of the liquid feed system for the two-stage pressure atomizer nozzle, different liquids (oil, water) being atomized in the two stages.

FIG. 9 illustrates another embodiment variant in a manner similar to FIG. 8. The pressure atomizer nozzle is in this case fed with water 51 via a feed line 44 and with oil 12 via a feed line 45. A pump 42 and, downstream, a shut-off valve 50 by means of which the lines 44 and 45 can be selectively closed is arranged in each of the lines 44 and 45. The quantity of liquids 12, 51 to be atomized is controlled by means of the control valves 46, 47. If, as indicated in FIG. 9, a plurality of burners, those of the gas turbine combustion chamber for example, is supplied with liquid fuel 12 and water 51 by way of this liquid feed system, then, at start-up or at partial load, the nozzle can be operated by finely atomizing only oil 12 via the main swirl stage. The swirl stage can here be designed for maximum pressure at a maximum fuel gas flow $m_{BS}$. At higher load or full load, water 51 is supplied via the line 44. Water 51 and oil 12 mix in the chamber 39 and form an emulsion which is atomized as it emerges from the nozzle. This leads to the lowering of the $NO_x$ emissions. Another advantage obtained here is that only one control valve is necessary per atomizer stage, that only one oil line is necessary for gas turbine operation and that the swirl stage can be designed for pure oil operation, since the supply of water 51 via the line 44 leads to an increase in the total mass flow at the same pressure.

Figure 10:
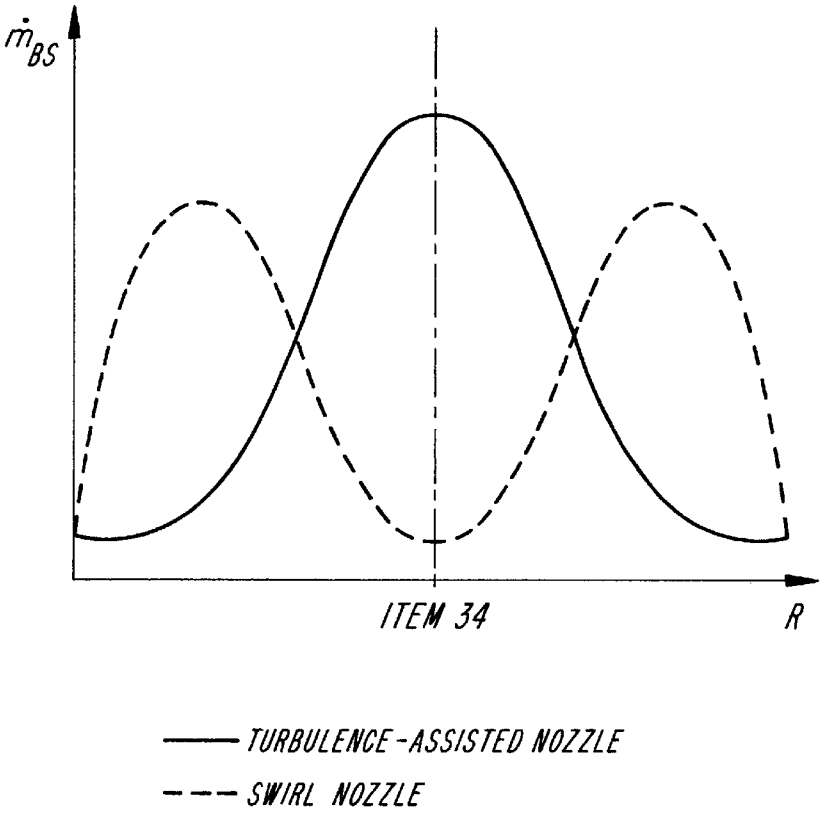
FIG. 10 shows a schematic representation of the mass flow distribution for a nozzle in accordance with FIG. 1.

FIG. 10 shows the distribution of the fuel mass flow $m_{BS}$ as a function of the radius R of the spray in the case of a pressure atomizer nozzle in accordance with the embodiment variant illustrated in FIG. 1, at a certain distance from the nozzle. If only the turbulence-producing stage is operated, a very narrow spray cone angle $\phi$ is achieved. If, on the other hand, only the swirl production stage is operated, the effect is a larger spray cone angle $\phi$. In the case of combined operation of both stages, the mass distribution between the two stages can be varied continuously.

Figure 11:
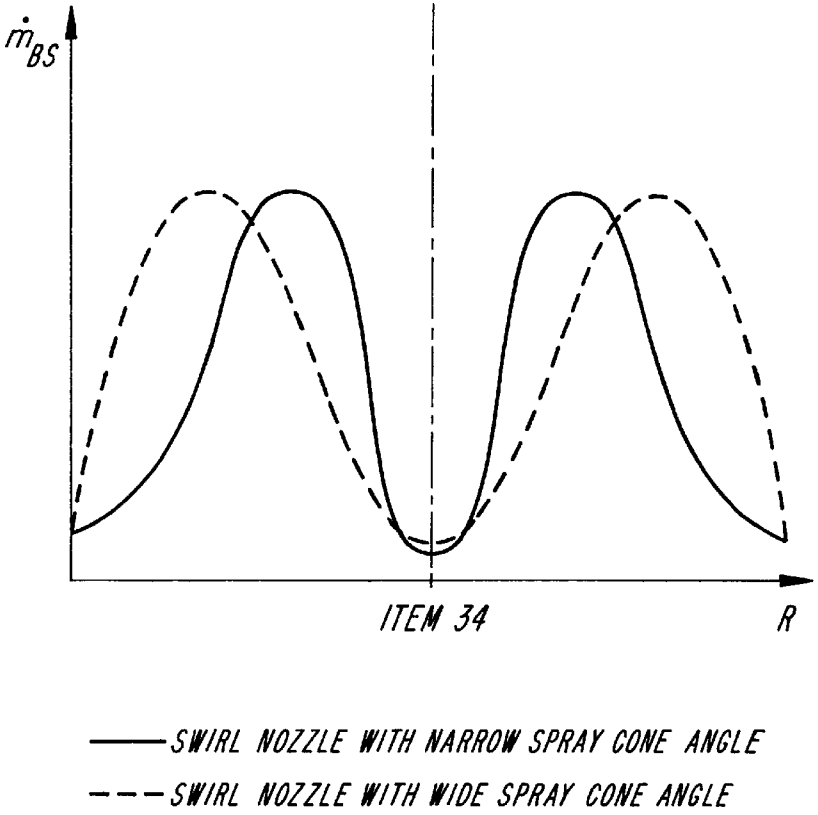
FIG. 11 shows a schematic representation of the mass flow distribution for a nozzle in accordance with FIG. 4.

FIG. 11 shows the distribution of the fuel mass flow $m_{BS}$ as a function of the radius R of the spray in the case of a pressure atomizer nozzle in accordance with the embodiment variant illustrated in FIG. 4, at a certain distance from the nozzle. In the case of combined operation of the two swirl stages operating with different spray cone angles $\phi$, the mass flow distribution can likewise be varied between the two stages.

The pressure atomizer nozzle according to the invention can, for example, be installed in a gas turbine burner and be operated as follows:

First of all, a pressure atomizer nozzle in an embodiment variant in accordance with FIG. 1 will be used. Since a very narrow spray cone angle $\phi$ is desired for full load and overload, only the turbulence-assisted atomizer stage is used. For this purpose, the entire fuel mass flow to be atomized is fed to the turbulence chamber 39 without swirl via at least one feed channel 41 (four feed channels 41 according to FIG. 1), in which a highly turbulent flow is produced, which then passes through the nozzle bore 33 into the burner. At nozzle feed pressures of about 100 bar, this main stage provides very fine atomization with an extremely narrow spray cone angle $\phi$ (about 20°). In partial and low load operation, this turbulence-assisted pressure atomizer stage is combined with a swirl stage to produce small droplets at low throughputs. For this purpose, some of the fuel to be atomized is fed to the chamber 30 with a swirl via at least one further feed channel 38 (four feed channels 38 according to FIG. 1), the turbulence chamber 39 thus additionally being used as a swirl chamber. The rotary motion produces a hollow conical flow at the nozzle bore 33. From a certain proportion by mass onwards passed through the swirl stage, the fuel emerges from the nozzle purely as a film. If the proportion of the fuel mass flow passed through the swirl stage is increased as the total fuel mass falls, the fuel feed pressure can be held at a high level (>10 bar), and fine atomization can thus be maintained even at a low mass flow. In addition, at low load the spray cone angle $\phi$ is thereby increased. Since the penetration depth of the fuel spray into the airflow is less at low load than at full load, this is compensated for by the larger spray cone angle $\phi$. For full load and overload, a very narrow spray cone angle $\phi$ is desired. For this purpose, the fuel mass flow flowing in through the swirl channels 38 must be completely shut off, so that the behavior of a pure turbulence-assisted pressure atomizer nozzle is achieved.

If a pressure atomizer nozzle in accordance with FIG. 4 is used, then, in full-load and overload operation of the gas turbine, the entire fuel to be atomized is fed with little swirl to the swirl chamber 39 via at least one feed channel 41*a* (four feed channels 41*a* according to FIG. 4), and a flow with a swirl is produced there which then passes into the outer space through the nozzle bore 33. By means of the small degree of swirl, a narrow spray cone angle $\phi$ is achieved and, at high pressures, this leads to fine atomization of the fuel. In partial- and low-load operation, some of the fuel to be atomized is additionally fed into the chamber 39 with a greater swirl via the further feed channel or channels 38 (four feed channels 38 according to FIG. 4). A flow with a greater swirl is thereby produced in the chamber 39, and this then passes through the nozzle bore 33 into the outer space, the proportion of the fuel mass flow with the greater swirl fed in by the further swirl stage being increased as the total fuel mass flow falls. The high degree of swirl leads to a larger spray cone angle $\phi$, which in turn compensates for the lower penetration depth of the fuel spray into the airflow. By means of the variable configuration of the spray cone angle $\phi$, optimum matching of the atomization of the fuel to the respective operating conditions of the gas turbine can be accomplished. In contrast to customary two-stage swirl nozzles, both stages are combined in a common swirl chamber in the embodiment according to the invention. It is furthermore possible to atomize different liquids, e.g. oil 12 and water 51, in the two stages, depending on the load range.

The pressure atomizer nozzle according to the invention can, for example, be installed in a premix burner of the double-cone type, the basic construction of which is described in U.S. Pat. No. 4,932,861 to Keller et al.

Figure 12:
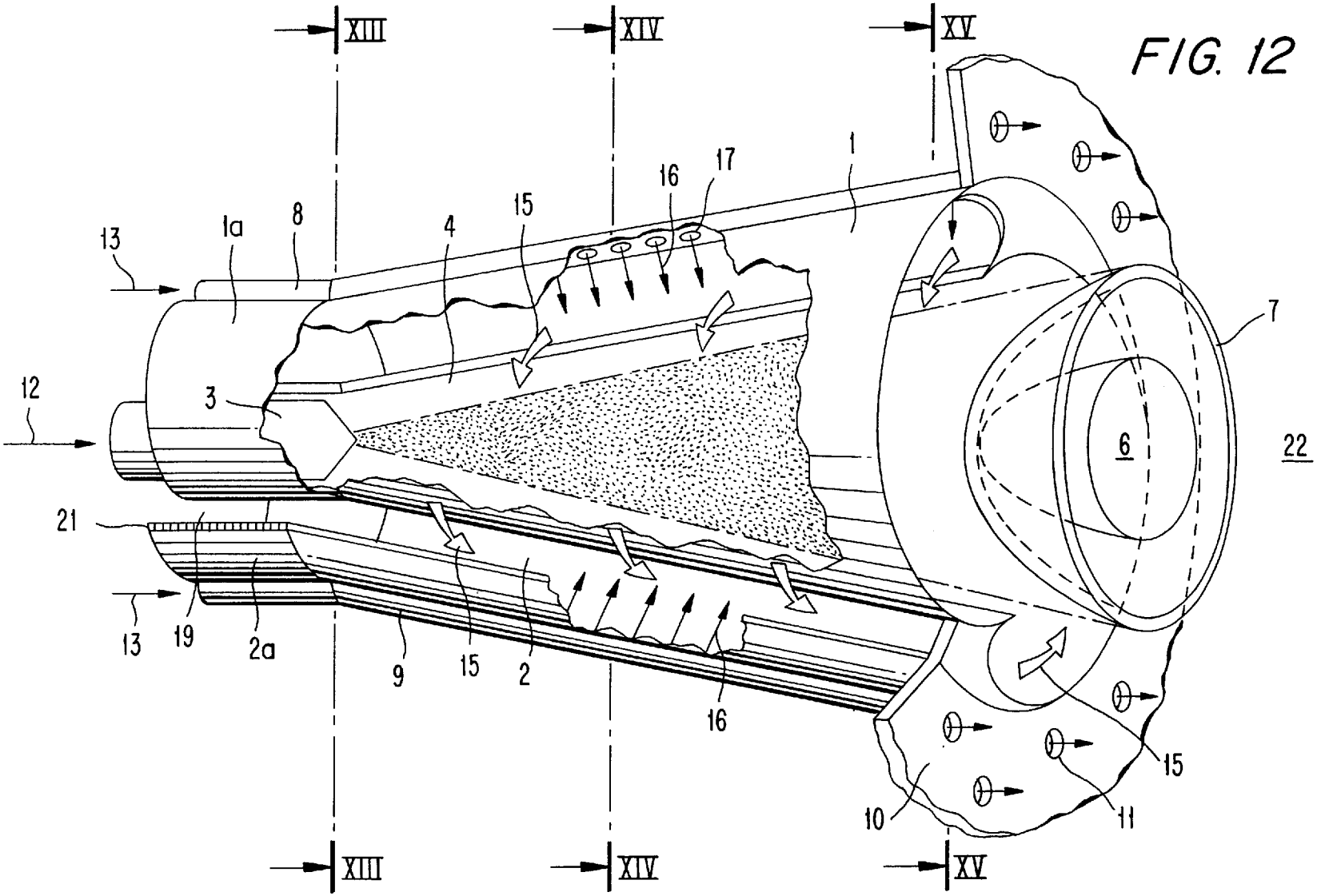
FIG. 12 shows a premix burner of the double-cone design in perspective representation.

FIG. 12 shows, in perspective representation, the double-cone burner with integrated premixing zone. The two partial conical bodies 1, 2*b* are arranged radially offset relative to one another as regards their longitudinal axes 1*b*, 2 b of symmetry. This creates respective tangential air inlet slots 19, 20 with opposite directions of inflow on both sides of the partial conical bodies 1, 2 and, through these air inlet slots, the combustion air 15 flows tangentially into the interior 14 of the burner, i.e. into the conical cavity formed by the two partial conical bodies 1, 2. The partial conical bodies 1, 2 widen rectilinearly in the direction of flow, i.e. they are at a constant angle $\alpha$ to the burner axis 5. The two partial conical bodies 1, 2 each have a cylindrical initial part 1*a*, 2*a*, which likewise extend in an offset manner. The pressure atomizer nozzle 3 according to the invention is located in this cylindrical initial part 1*a*, 2*a* and is arranged approximately at the narrowest cross section of the conical interior 14 of the burner. The burner can, of course, also be embodied without a cylindrical initial part, i.e. in purely conical form. The liquid fuel 12 is atomized in the manner described above by means of the nozzle 3. Different spray cone angles $\phi$ are obtained depending on the respective operating conditions. The fuel spray 4 is surrounded in the interior 14 of the burner by the combustion airflow 15 flowing tangentially into the burner through the air inlet slots 19, 20, and ignition of the mixture takes place only at the outlet of the burner, the flame being stabilized in the region at the burner mouth by a reverse-flow zone 6.

The two partial conical bodies 1, 2 each have a fuel feed line 8, 9 along the air inlet slots 19, 20 and these fuel feed lines are provided longitudinally with openings 17 through which another fuel 13 (gaseous or liquid) can flow. This fuel 13 is mixed into the combustion air 15 flowing into the burner interior through the tangential air inlet slots 19, 20, this being illustrated by arrows 16. Mixed-mode operation of the burner via the nozzle 3 and the fuel feed lines 8, 9 is possible.

Arranged on the combustion-space side is a front plate 10 with openings 11 through which, when required, diluting air or cooling air can be fed to the combustion space 22. This supply of air furthermore ensures that flame stabilization takes place at the outlet of the burner. A stable flame front 7 with a reverse-flow zone 6 is established there.

Figure 13:
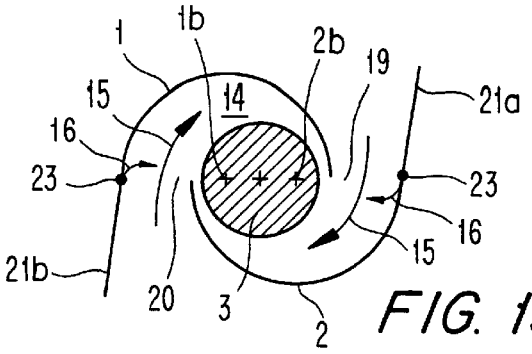
FIG. 13 shows a simplified section in the plane XIII—XIII in accordance with FIG. 12.
Figure 14:
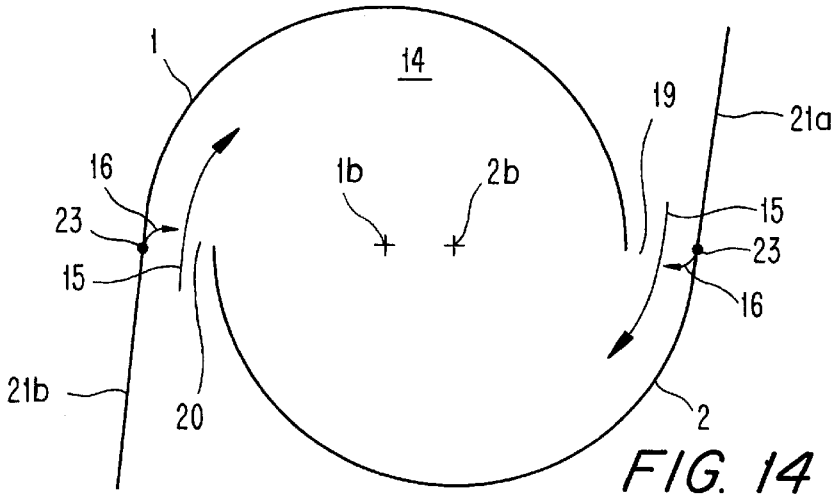
FIG. 14 shows a simplified section in the plane XIV—XIV in accordance with FIG. 12.
Figure 15:
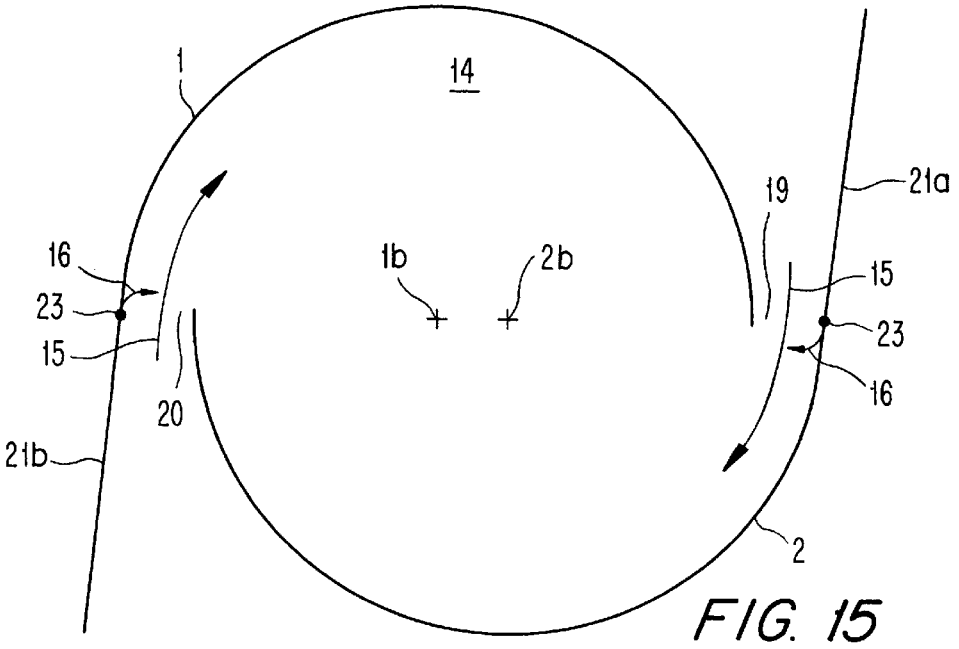
FIG. 15 shows a simplified section in the plane XV—XV in accordance with FIG. 12.

FIGS. 13 to 15 show the arrangement of guide plates 21*a*, 21*b*. These can, for example, be open or closed around a pivoting point 23, thereby varying the original size of the gap of the tangential air inlet slots 19, 20. The burner can, of course, also be operated without these guide plates 21*a*, 21*b*.

Figure 16:
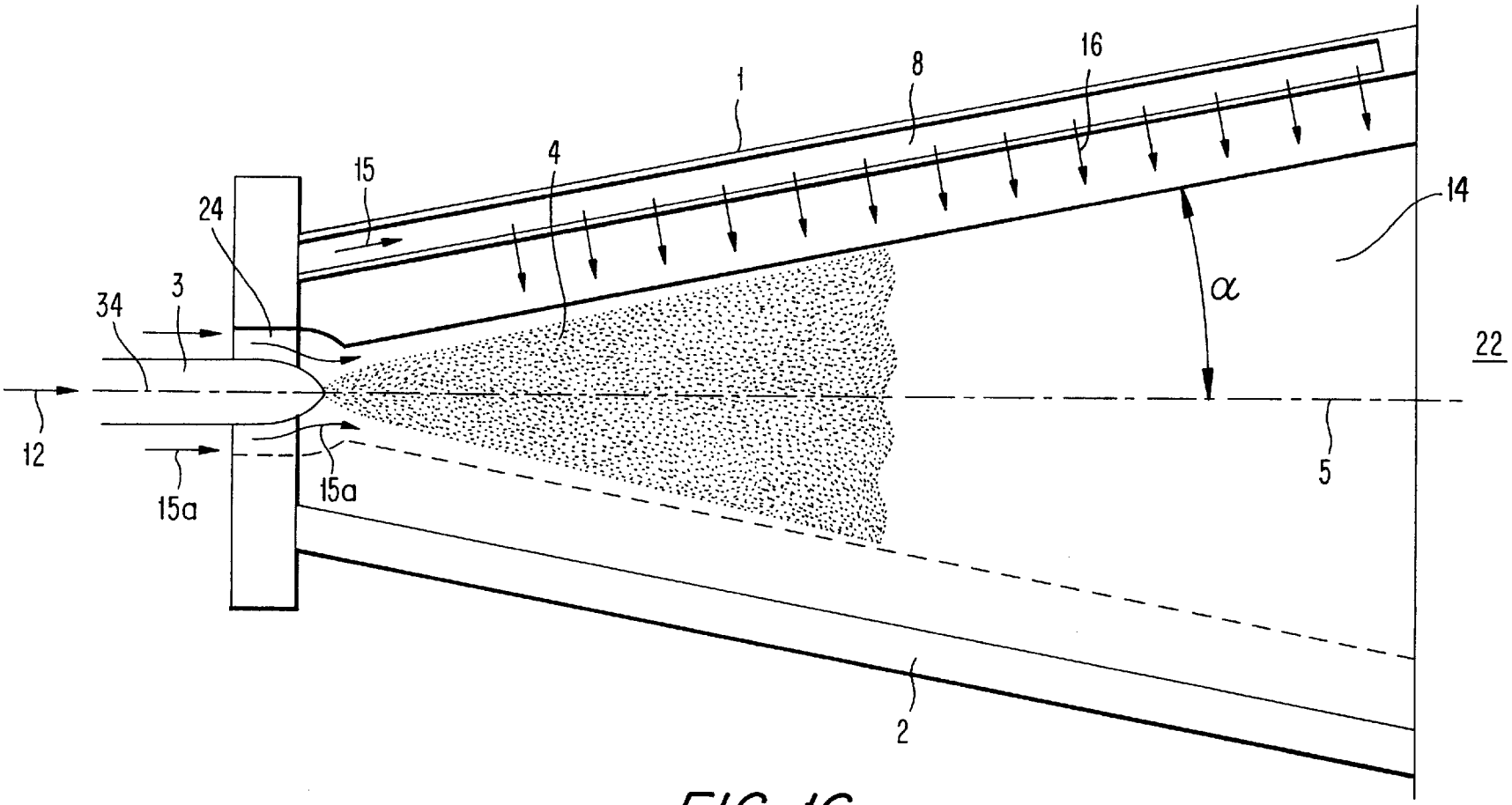
FIG. 16 shows a schematic view of a double-cone burner with enveloping airflow close to the nozzle

Since there is the risk, with these burners, that separation and recirculation zones will form close to the nozzle, this is prevented, in accordance with FIG. 16, by arranging around the nozzle 3 a channel 24 through which an enveloping airstream 15*a* flows as scavenging air. The enveloping airstream 15*a* amounts to about 3 to 7% of the combustion airstream.

Figure 17:
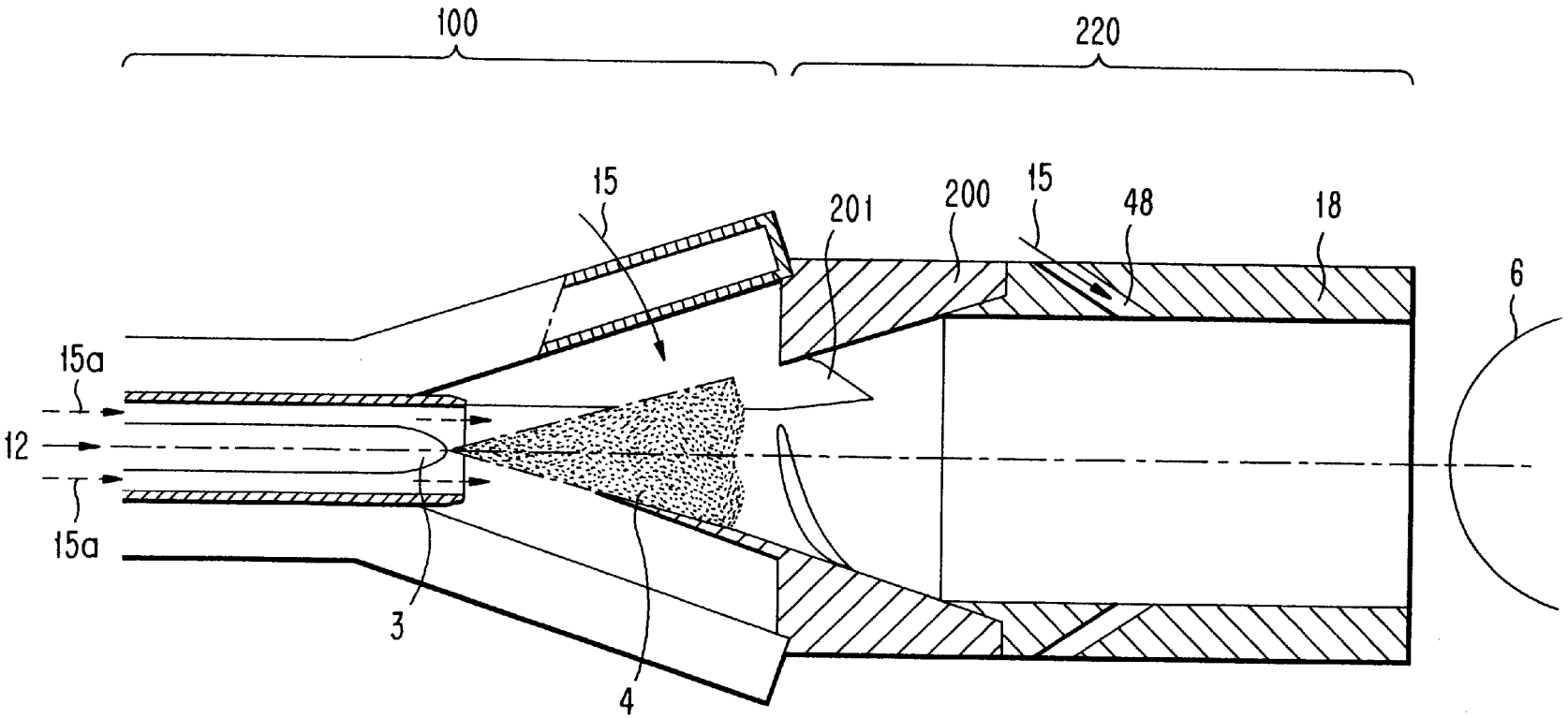
FIG. 17 shows a schematic view of a four-slot burner with enveloping airflow close to the nozzle.

It is, of course, also possible with the method just described to operate a burner (see FIG. 17) essentially comprising a swirl generator 100 for a combustion airstream 15 and means for injecting a fuel in which a mixing section 220 is arranged downstream of the swirl generator 100 and the said mixing section has, within a first part 200 of the section, transfer channels 201 running in the direction of flow and serving for the transfer of a flow formed in the swirl generator 100 into the through flow cross section of the mixing section 220 downstream of the transfer channels 201, the means for injecting the fuel being a pressure atomizer nozzle according to the invention which is operated in accordance with the methods described above. The swirl generator 100 is preferably a conical structure upon which the combustion airstream flowing in tangentially impinges tangentially from several directions (e.g. via four slots). This combustion airstream 15 envelops the fuel droplet spray 4 formed prior to this by atomization of the liquid fuel 12 in the two-stage pressure atomizer nozzle 3. The flow which forms is transferred seamlessly into a transitional piece 200, which is extended by a tube 18, by means of a transitional geometry (transfer channels 201) provided downstream of the swirl generator 100. The two parts form the mixing section 220, adjoining which on the downstream side is the actual combustion chamber (not shown here). The mixing section allows very good premixing of the fuel with the combustion air, allows the flow to be conducted with little loss and prevents flashback of the flame from the combustion chamber by means of a maximum of axial velocity at the axis. Since the axial velocity falls towards the wall, holes 48 are provided in the wall of the tube 18, and the combustion air 15 flows in through these holes, causing an increase in velocity along the wall. Only downstream of the mixing tube 220 does a central reverse-flow zone 6 form with the properties of a flame holder. Here too, it is advantageous if 3 to 7% of the combustion airstream 15 is guided around the pressure atomizer nozzle as an enveloping airstream 15*a*. In this way, in turn, separation and recirculation zones close to the nozzle are prevented.

Obviously, numerous modifications and variations of the present invention are possible in light of the above teachings. It is therefore to be understood that in the scope of the appended claims, the invention may be practiced otherwise than as specifically described herein.

What is claimed as new and desired to be secured by Letters Patent of the United States is:

1. A method for operating a pressure atomizer nozzle having a nozzle body enclosing a chamber for at least one of fluid tubulence and swirl, the body having a nozzle bore connecting the chamber to an outer space and having at least one first feed channel for feeding a liquid to be atomized into the chamber under pressure, the body having at least one further feed channel for feeding one of a portion of the liquid to be atomized or a second liquid to be atomized into the chamber under pressure, the at least one further feed channel being formed to generate a swirl, the method comprising the steps of:

in full-load and overload operation, introducing all of a liquid to be atomized through the at least one first feed channel for a swirl-free turbulence flow to the turbulence chamber, so that a highly turbulent flow being produced in the chamber passes into the outer space through the nozzle bore, and in part-load and low-load operation, feeding a first portion of the liquid to be atomized through the at least one first feed channel for turbulent flow into the chamber and a remaining portion through the at least one further feed channel for a flow with a high degree of swirl into the chamber, a total flow produced in the chamber passes into the, wherein a proportion of liquid fed in by the at least one further feed channel being increased as a total mass flow of liquid decreases.

2. The method as claimed in claim 1 wherein in changing between full load and part load operation, the method includes continuing feeding through the at least one first feed channel for a smooth switchover between load stages.

3. The method as claimed in claim 1 comprising the steps of feeding liquid through both the at least one first feed channel and the at least one further feed channel simultaneously and varying a throughput to each feed channel for controlling a load.

4. The method as claimed in claim 1, comprising the step of feeding liquid to one of the at least one first feed channel and at least one further feed channel.

5. The method for operating a pressure atomizer nozzle including a nozzle body enclosing a chamber for at least one of fluid turbulence and swirl, the body having a nozzle bore connecting the chamber to an outer space and having at least one first feed channel for feeding a liquid to be atomized into the chamber under pressure with a swirl, the body having at least one further feed channel for feeding one of a portion of the liquid to be atomized or a second liquid to be atomized into the chamber under pressure with a swirl greater than the swirl from the at least one first feed channel, the method comprising the steps of:

in full-load and overload operation, feeding all of a liquid to be atomized into the chamber through the at least one feed channel, a swirling flow being produced there which then passes into the outer space through the nozzle bore, in part-load and low-load operation, feeding a first portion of the liquid to be atomized into the chamber through the at least one feed channel, and feeding a remaining second portion of the liquid into the chamber through the at least one further feed channel, wherein the first and second portions combine in the chamber producing there a flow with a high degree of swirl which then passes into the outer space through the nozzle bore, wherein a proportion of liquid fed in through the further swirl stage is increased as a total mass flow of liquid decreases.

6. The method as claimed in claim 5 wherein in changing between full load and part load operation, the method includes continuing feeding through the at least one first feed channel for a smooth switchover between load stages.

7. The method as claimed in claim 5 comprising the steps of feeding liquid through both the at least one first feed channel, and the at least one further feed channel simultaneously and varying a throughput to each feed channel for controlling a load.

8. The method as claimed in claim 5, comprising the step of feeding liquid to one of the at least one first feed channel and at least one further feed channel.

9. A method for burning liquid fuel in a burner without a premixing section, the burner having an interior space and a nozzle spraying a conical column of liquid fuel which spreads out in a direction of flow in the interior of the burner by atomization of the fuel, wherein the atomized fuel does not wet the walls of the interior and wherein a combustion airstream flows tangentially into the interior space to surround the fuel spray, ignition of the mixture taking place at an outlet of the burner and a flame being stabilized in a region of the burner mouth by a reverse-flow zone, wherein the nozzle is a pressure atomizer nozzle comprising a nozzle body enclosing a chamber for at least one of fluid tubulence and swirl, the body having a nozzle bore connecting the chamber to an outer space and having at least one first feed channel for feeding a liquid to be atomized into the chamber under pressure, the body having at least one further feed channel for feeding one of a portion of the liquid to be atomized or a second liquid to be atomized into the chamber under pressure, the at least one further feed channel being formed to generate a swirl, the method comprising the steps of in full-load and overload operation, introducing all of a liquid to be atomized through the at least one first feed channel for a swirl-free turbulence flow to the turbulence chamber, so that a highly turbulent flow being produced in the chamber passes into the outer space through the nozzle bore, and in part-load and low-load operation, feeding a first portion of the liquid to be atomized through the at least one first feed channel for turbulent flow into the chamber and a remaining portion through the at least one further feed channel for a flow with a high degree of swirl into the chamber, a total flow produced in the chamber passes into the outer space through the nozzle bore, wherein a proportion of liquid fed in by the at least one further feed channel being increased as a total mass flow of liquid decreases, and wherein 3 to 7% of the combustion airstream is guided around the nozzle as an enveloping airstream.

10. A method for burning liquid fuel in a burner with a premixing section, the burner having an interior space and a nozzle injecting a conical column of liquid fuel which spreads out in a direction of flow in the interior space by atomization of the fuel and does not wet walls of the interior and wherein a combustion airstream flows tangentially into the burner space to surround the fuel spray, a swirling flow thereby being produced which, downstream of the burner interior, passes into a mixing section extending in the direction of flow, and wherein ignition of the mixture takes place only at an outlet of the burner, the flame being stabilized in a region of the burner mouth by a reverse-flow zone, wherein the nozzle is a pressure atomizer nozzle, having a nozzle body enclosing a chamber for at least one of fluid turbulence and swirl, the body having a nozzle bore connecting the chamber to an outer space and having at least one first feed channel for feeding a liquid to be atomized into the chamber under pressure, the body having at least one further feed channel for feeding one of a portion of the liquid to be atomized or a second liquid to be atomized into the chamber under pressure, the at least one further feed channel being formed to generate a swirl, the method comprising the steps of:

in full-load and overload operation, introducing all of a liquid to be atomized through the at least one first feed channel for a swirl-free turbulence flow to the turbulence chamber, so that a highly turbulent flow being produced in the chamber passes into the outer space through the nozzle bore, and in part-load and low-load operation, feeding a first portion of the liquid to be atomized through the at least one first feed channel for turbulent flow into the chamber and a remaining portion through the at least one further feed channel for a flow with a high degree of swirl into the chamber, a total flow produced in the chamber passes into the outer space through the nozzle bore, wherein a proportion of liquid fed in by the at least one further feed channel being increased as a total mass flow of liquid decreases, and wherein 3 to 7% of the combustion airstream is guided around the nozzle as an enveloping airstream.

11. A pressure atomizer nozzle comprising a nozzle body enclosing a chamber for at least one of turbulence and swirl, the body having a nozzle bore connected to the chamber and having a smaller diameter than a diameter of the chamber to produce a spray to an outer space and having at least one first feed channel for feeding a liquid to be atomized into the chamber under pressure and without swirl, the body having at least one further feed channel for feeding one of a portion of the liquid to be atomized or a second liquid to be atomized into the chamber under pressure, the at least one further feed channel being formed to generate a swirl in the chamber, wherein the nozzle bore is arranged in a cap of the nozzle body, and wherein the nozzle body includes a first tube and the second tube having smaller outside diameter than the first tube and inserted in the first tube, the second tube enclosing the chamber, the second tube extending to the cap, and wherein said at least one further feed channel comprises a slot provided in a cap end of the second tube, said slot being arranged tangentially relative to the chamber for forming a swirl channel, the slot connecting an annular space between the first tube and the second tube to the chamber, and further comprising a filler piece mounted in the second tube spaced from the cap to define the chamber therebetween, and wherein the at least one first feed channel is arranged parallel to nozzle body axis in the filler piece.

12. A pressure atomizer nozzle comprising a nozzle body enclosing a chamber for at least one of turbulence and swirl, the body having a nozzle bore connected to the chamber and having a smaller diameter than a diameter of the chamber to produce a spray to an outer space and having at least one first feed channel for feeding a liquid to be atomized into the chamber under pressure and without swirl, the body having at least one further feed channel for feeding one of a portion of the liquid to be atomized or a second liquid to be atomized into the chamber under pressure, the at least one further feed channel being formed to generate a swirl in the chamber, wherein the nozzle bore is arranged in a cap of the nozzle body, and wherein the nozzle body includes a first tube and a second tube having a smaller outside diameter than the first tube and being inserted in the first tube, the second tube enclosing the chamber and extending to the cap, and wherein said at least one further feed channel comprises a slot provided in a cap end of the second tube, said slot being arranged tangentially relative to the chamber for forming a swirl channel, the slot connecting an annular space between the first tube and the second tube to the chamber, and further comprising a filler piece mounted in the second tube spaced from the cap, the chamber being enclosed therebetween, and wherein the first feed channel is arranged as an annular gap between the filler piece and inner walls of the second tube.

13. A pressure atomizer nozzle comprising a nozzle body enclosing a chamber for at least one of turbulence and swirl, the body having a nozzle bore connected to the chamber and having a smaller diameter than a diameter of the chamber to produce a spray to an outer space and having at least one first feed channel for feeding a liquid to be atomized into the chamber under pressure, the body having at least one further feed channel for feeding one of a portion of the liquid to be atomized or a second liquid to be atomized into the chamber under pressure, the at least one further feed channel being formed to generate a swirl in the chamber, wherein the nozzle bore is arranged in a cap of the nozzle body, and wherein the nozzle body includes a first tube and a second tube having a smaller outside diameter than the first tube and being inserted in the first tube, and annular channel formed between the tubes proving a feed line for a swirl stage, and further comprising a filler piece mounted in the second tube spaced from the cap to define the chamber, wherein the at least one further channel comprises at least one tangentially arranged swirl channel arranged in the and second tube connecting the annular channel to the chamber, and wherein the at least one feed channel is arranged in the filler piece parallel to a nozzle body axis, as a turbulence channel for the liquid to be atomized.

14. A pressure atomizer nozzle comprising a nozzle body enclosing a chamber for at least one of turbulence and swirl, the body having a nozzle bore connected to the chamber and having a smaller diameter than a diameter of the chamber to produce a spray to an outer space and having at least one first feed channel for feeding a liquid to be atomized into the chamber under pressure, the body having at least one further feed channel for feeding one of a portion of the liquid to be atomized or a second liquid to be atomized into the chamber under pressure, the at least one further feed channel being formed to generate a swirl in the chamber, wherein the nozzle bore is arranged in a cap of the nozzle body, and wherein the nozzle body includes a first tube and a second tube having a smaller outside diameter than the first tube and being inserted in the first tube, an annular channel formed between the tubes providing a feed line for a swirl stage and further comprising a filler piece mounted in the second tube and defining the chamber with the cap, wherein the at least one further feed channel is a tangentially directed swirl channel arranged in the second tube for connecting the annular channel to the chamber, and the at least one feed channel is arranged parallel to nozzle body axis in the filler piece to act as a turbulence channel for the liquid to be atomized.

15. A pressure atomizer nozzle comprising a nozzle body enclosing a chamber for at least one of turbulence and swirl, the body having a nozzle bore connected to the chamber and having a smaller diameter than a diameter of the chamber to produce a spray to an outer space and having at least one first feed channel for feeding a liquid to be atomized into the chamber under pressure and with swirl, the body having at least one further feed channel for feeding one of a portion of the liquid to be atomized or a second liquid to be atomized into the chamber under pressure, the at least one further feed channel being formed to generate a swirl in the chamber, wherein the nozzle bore is arranged in a cap of the nozzle body, the nozzle body including a first tube and a second tube having a smaller outside diameter than the first tube and inserted in the first tube, the second tube enclosing the chamber, the second tube extending to the cap, and the at least one further feed channel comprising at least one slot provided in a cap end of the second tube, said slot being arranged tangentially to form a swirl channel connecting annular space between the first tube and the second tube to the chamber and further comprising a filler piece mounted in the second tube spaced from the cap to define therebetween the chamber, and wherein the at least one first feed channel is formed tangentially as at least one swirl channel in the filler piece.

16. The pressure atomizer nozzle as claimed in claim 15 wherein the at least one first feed channel is formed to produce a greater swirl than the at least one further feed channel.

* * * * *